US006199621B1

(12) United States Patent
Weyer et al.

(10) Patent No.: US 6,199,621 B1
(45) Date of Patent: Mar. 13, 2001

(54) METHOD AND INSTALLATION FOR PRODUCING SLABS IN A CONTINUOUS CASTING PLANT

(75) Inventors: Axel Weyer, Wuppertal; Lothar Fischer, Kaarst, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/168,039

(22) Filed: Oct. 7, 1998

(30) Foreign Application Priority Data

Oct. 11, 1997 (DE) ..... 197 45 056

(51) Int. Cl.[7] ..... B22D 11/128

(52) U.S. Cl. ..... 164/484; 164/442; 164/454; 164/413

(58) Field of Search ..... 164/484, 454, 164/413, 442, 441

(56) References Cited

U.S. PATENT DOCUMENTS 5,348,074 * 9/1994 Streubel ..... 164/454
5,709,261 * 1/1998 Streubel ..... 164/454
5,915,460 * 6/1999 Courson et al. ..... 164/484

FOREIGN PATENT DOCUMENTS 1963146 6/1971 (DE) .
4306853 3/1996 (DE) .

* cited by examiner

*Primary Examiner*—Harold Pyon
*Assistant Examiner*—I.-H Lin
(74) *Attorney, Agent, or Firm*—Friedrich Kueffner

(57) ABSTRACT

A method and an installation for producing slabs in a continuous casting plant which includes a strand guiding unit arranged following the casting mold and divided into segments. Each segment is composed of a two-part segment frame whose frame parts are braced together by hydraulic cylinders. Rollers for supporting and conveying the solidifying cast strand are mounted in pairs opposite each other, wherein at least one of these rollers, i.e., the drive roller, is pressed with a defined adjusting force against the cast strand for transmitting the strand conveying forces.

6 Claims, 4 Drawing Sheets

31
16
13
12
18
30
26

METHOD AND INSTALLATION FOR PRODUCING SLABS IN A CONTINUOUS CASTING PLANT

BACKGROUND OF THE INVENTION

1. Field of the Invention

The present invention relates to a method and an installation for producing slabs in a continuous casting plant. The continuous casting plant includes a strand guiding means arranged following the casting mold and divided into segments which each is composed of a two-part segment frame whose frame parts are braced together by means of hydraulic cylinders, wherein pairs of oppositely located rollers for supporting and for conveying the solidifying cast strand are mounted in the frame parts, and wherein at least one of these rollers, i.e., the drive roller, is pressed with a defined adjusting force against the cast strand for transmitting the conveying forces.

2. Description of the Related Art

DE 19 63 146 C1 discloses a plant for producing slabs in which the parts of the frame of the strand guiding means with their oppositely located rollers are combined to form segments, wherein the segment frames are composed of two yoke frames supporting the rollers and the yoke frames are adjustable through tension anchors and spacer pieces to the casting size.

In conventional strand guiding stands using the segment configuration of the type described in DE 19 63 146 C1, in curved installations in which the cast strand is guided from the vertical casting direction into the horizontal rolling direction, the upper frame and the lower frame of each segment are braced relative to each other by means of four hydraulic cylinders which connect the frames and are arranged at the corners outside of the travel path of the cast strand. The adjustment to different strand thicknesses is effected by means of spacer pieces against which the frame parts are pressed.

Because of this type of construction, a change of the distance between the rollers during the casting process is not possible.

In order to eliminate this deficiency, DE 43 06 853 C2 proposes to arrange a hydraulic plunger cylinder between the spacer pieces and the respective side frame part and to dimension the angular piston of this hydraulic plunger cylinder in such a way that in the pressureless state the hydraulic plunger cylinder fixes the segment parts to that distance between the rollers which corresponds to the desired strand thickness. This measure makes it possible to adjust the guide rollers in three defined positions.

Since in these known guiding strands the hydraulic cylinders press the segment frame parts against the spacer pieces and, thus, cannot act directly on the rollers which support and guide the cast strand, at least one of these rollers, i.e., the drive roller, is pressed by separate hydraulic adjusting cylinders (usually two adjusting cylinders for each drive roller) against the cast strand with the adjusting force required for the transmission for the strand conveying forces. This is usually effected in the middle of the segment, so that, depending on the introduced force, bending of the respective segment side frame may occur.

SUMMARY OF THE INVENTION

Therefore, it is the primary object of the present invention to further develop the construction of the strand guiding means of conventional continuous casting plants and especially to improve the existing drive concept.

In accordance with the present invention, a continuous casting plant for producing slabs includes a strand guiding means arranged following the casting mold and divided into segments, wherein each segment is composed of a two-part segment frame whose frame parts are braced together by means of hydraulic cylinders. Rollers for supporting and conveying the solidifying cast strand are mounted in pairs opposite each other, wherein at least one of these rollers, i.e., the drive roller, is pressed with a defined adjusting force against the cast strand for transmitting the strand conveying forces.

The method according to the present invention provides that bracing of the segment frame parts is effected in an infinitely variable manner by means of position-controlled and force-controlled segment adjusting cylinders which are also used for applying the adjusting force for the drive roller required for transmitting the strand conveying forces.

In accordance with the present invention, each segment of the strand guiding means has four position-controlled and force-controlled segment adjusting cylinders which connect and brace together the two segment frame parts at a distance from each other without the use of spacer pieces.

The infinitely variable adjustment of the segment positions by means of preferably four position-controlled and force-controlled segment adjusting cylinders, i.e., a conversion of the conventional segment clamping cylinders into segment adjusting cylinders, produces a defined introduction of the adjusting forces for conveying the cast strand in the strand guiding means for different process situations. This leads to an improvement in conveying the strand out of the system during operation and in cases of interruptions.

In addition, the present invention makes it possible by an appropriate position-controlled and force-controlled adjustment of the segment adjusting cylinders to transmit the required adjusting forces for the driven rollers to the pair of rollers at the entry side or exit side at the edge of the segment. Consequently, the drive roller can be switched from the previously used middle position in the segment to the entry side or the exit side of the segment. The segment adjusting cylinders then additionally perform the task of transmitting the adjusting forces for conveying the strand; this provides the advantage that bending of the segment side frames due to the previously used adjusting cylinders for the drive roller arranged in the middle no longer takes place because these additional adjusting cylinders are advantageously no longer required.

The measures according to the present invention provide an optimum force introduction for transmitting the strand conveying forces and the additional advantage is that by appropriate control of the position and force of the segment adjusting cylinders an anti-blocking control as well as an anti-slip control becomes possible for the drive roller. The principles of anti-blocking and anti-slip control are known to a person skilled in the art: it is necessary to measure the respective velocities of the driving part (drive roller) and the driven part (strand), i.e., the circumferential velocity of the drive roller and the linear velocity of the strand, and, in accordance with the measured values, the adjusting force is accordingly controlled to avoid slip or to release a blockage. Sensors for measuring velocities are well known in the art.

The installation according to the present invention for carrying out the above-described method is composed of a continuous casting plant with a strand guiding means divided into segments, wherein each segment has segment frame parts which are connected to each other and braced relative to each other at a distance without spacer pieces by means of four position-controlled and force-controlled segment adjusting cylinders.

In accordance with an advantageous further development of the invention, the drive roller is arranged at the segment edge in the area of the entry side or the exit side of the segment without using the previously provided separate adjusting cylinders.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
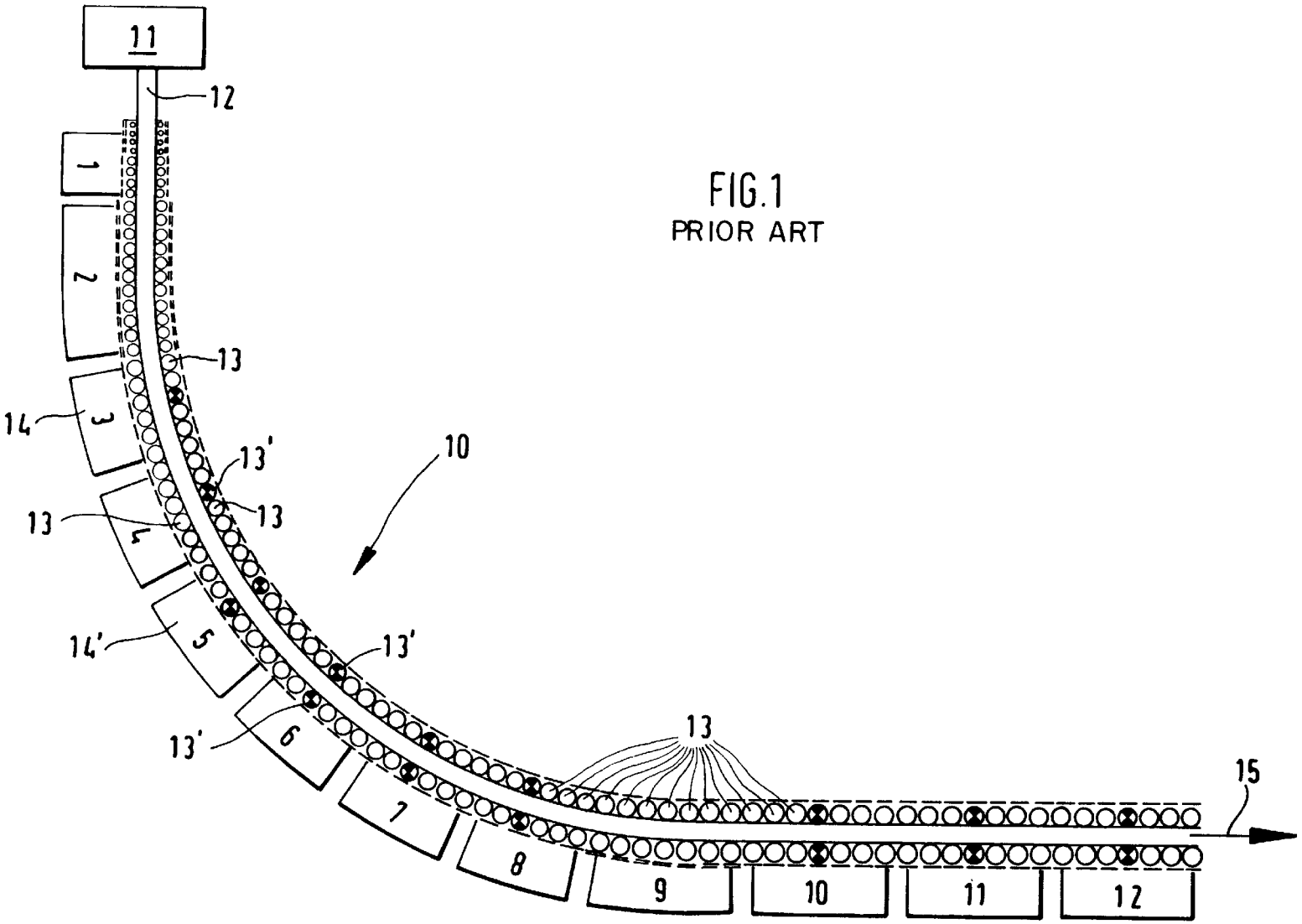
FIG.1 PRIOR ART
FIG. 1 is a schematic view of a strand guiding unit of a continuous casting plant including segments according to the prior art.

FIG. 1 of the drawing shows a strand guiding unit 10 of a conventional continuous casting plant. The strand guiding unit 10 is composed of altogether 12 segments 14, 14' in which the cast strand 12 emerging from the mold 11 is guided and conveyed by means of oppositely arranged rollers 13, 13' in an arc from the vertical casting direction into the horizontal rolling direction 15.

The rollers 13 of each segment 14 include one drive roller 13' arranged in the middle of the segment. In the third and fourth segments from the mold, one drive roller 13 each is provided. The additional segments 14' have two drive rollers 13' arranged opposite each other.

Figure 2:
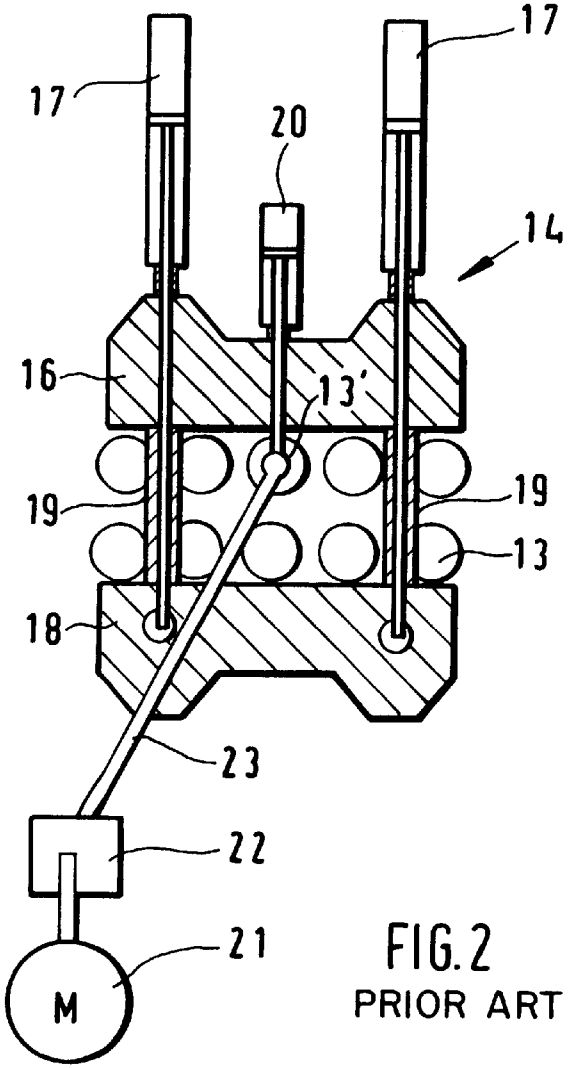
FIG.2 PRIOR ART
FIG. 2 is a sectional view of a segment according to the prior art, shown with drive.

FIG. 2 is a sectional view parallel to the conveying direction 26 showing a segment 14 according to the prior art with a drive roller 13'. The segment 14 is composed of a segment upper frame 16 which is braced by means of hydraulic clamping cylinders 17 against the segment lower frame 18. Spacer pieces 19, selected depending on the strand size, ensure a uniform spacing between the frame parts 16 and 18.

For transmitting the necessary strand conveying forces to the cast strand 12, the drive roller 13' arranged in the upper frame and in the middle of the segment 14 is pressed by means of two adjusting cylinders 20 arranged one behind the other against the cast strand 12, so that the torque produced by the motor 21 is transmitted from the motor 21 through a gear unit 22 and a drive shaft 23 in an optimum manner to the cast strand 12 for conveying the cast strand 12.

Figure 3:
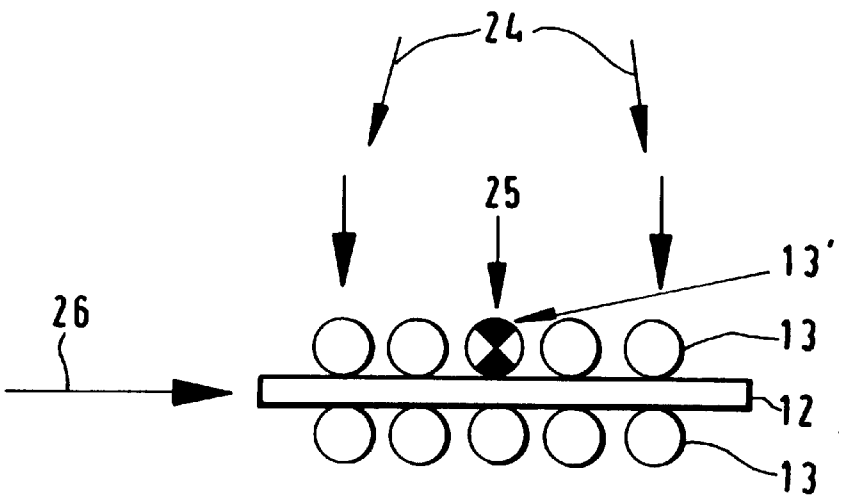
FIG.3 PRIOR ART
FIG. 3 is a schematic illustration of the forces to be applied on a segment according to FIG. 2.

FIG. 3 is a diagram showing the forces to be applied by the hydraulic cylinders 17 and 20 illustrated in FIG. 2. These forces are the clamping forces 24 required for bracing the segments and the adjusting force 25 required for transmitting the strand conveying forces; these forces are required to ensure that the rollers 13, 13' mounted in the segment frame parts 16 and 18 can operate as supporting and conveying members for transporting the cast strand 12 in the conveying direction 26.

Figures 4, 5:
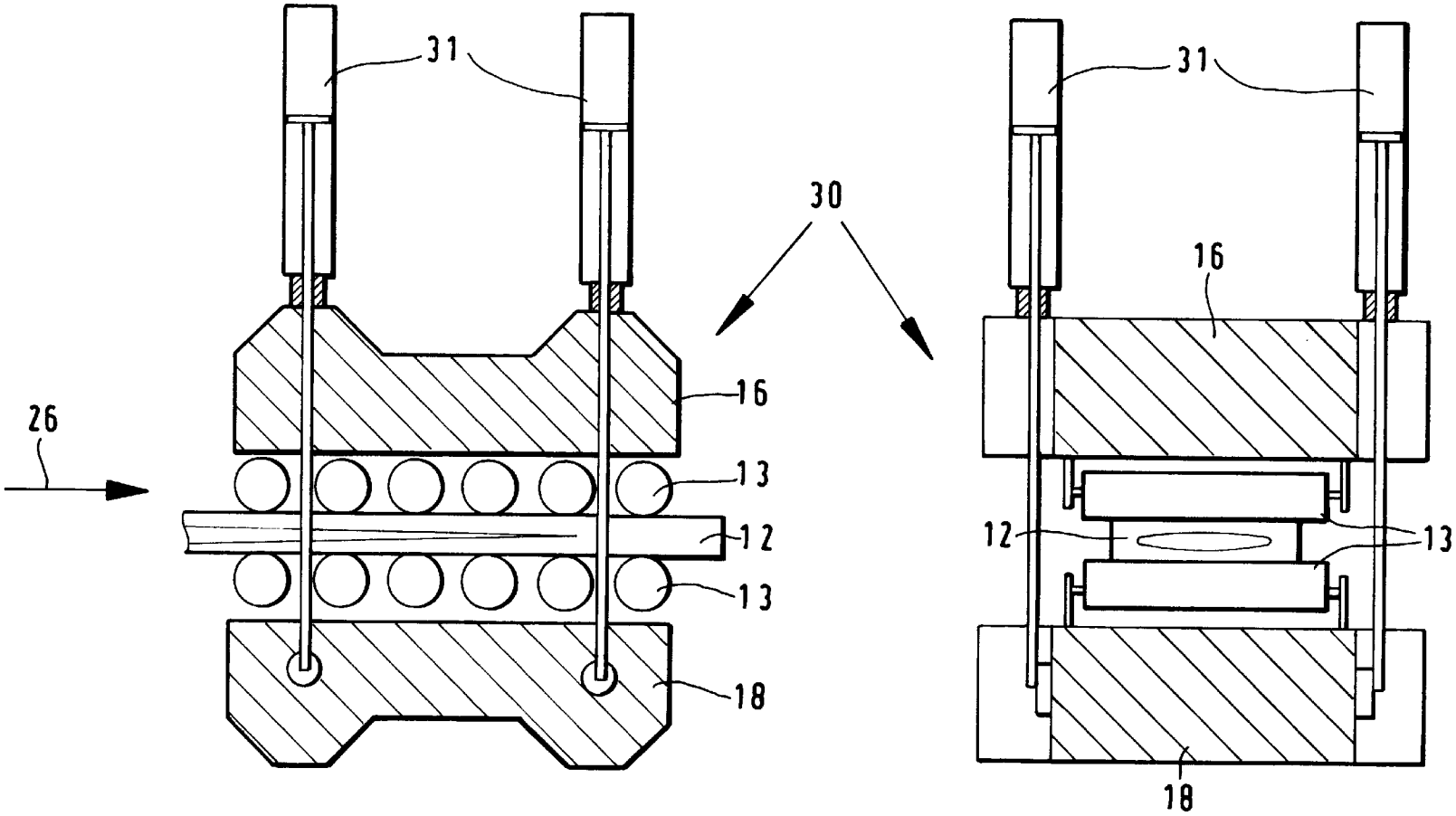
FIG. 4 is sectional view of a segment according to the present invention.
FIG. 5 is a sectional view, turned by 90°, of the segment of FIG. 4.

FIGS. 4 and 5 show a segment 30 according to the present invention in two sectional views. FIG. 4 is a sectional view parallel to the conveying direction 26 and FIG. 5 is a sectional view perpendicularly of the conveying direction 26.

In place of the hydraulic clamping cylinders which act against the spacer pieces 19 and brace the segment frame parts 16 and 18 of the known segments 14, the present invention provides position-controlled and force-controlled segment adjusting cylinders 31 at the segment 30, wherein the segment adjusting cylinders 31 can be controlled in such a way that spacer pieces are no longer required for maintaining the required distance between the rollers.

Figure 6:
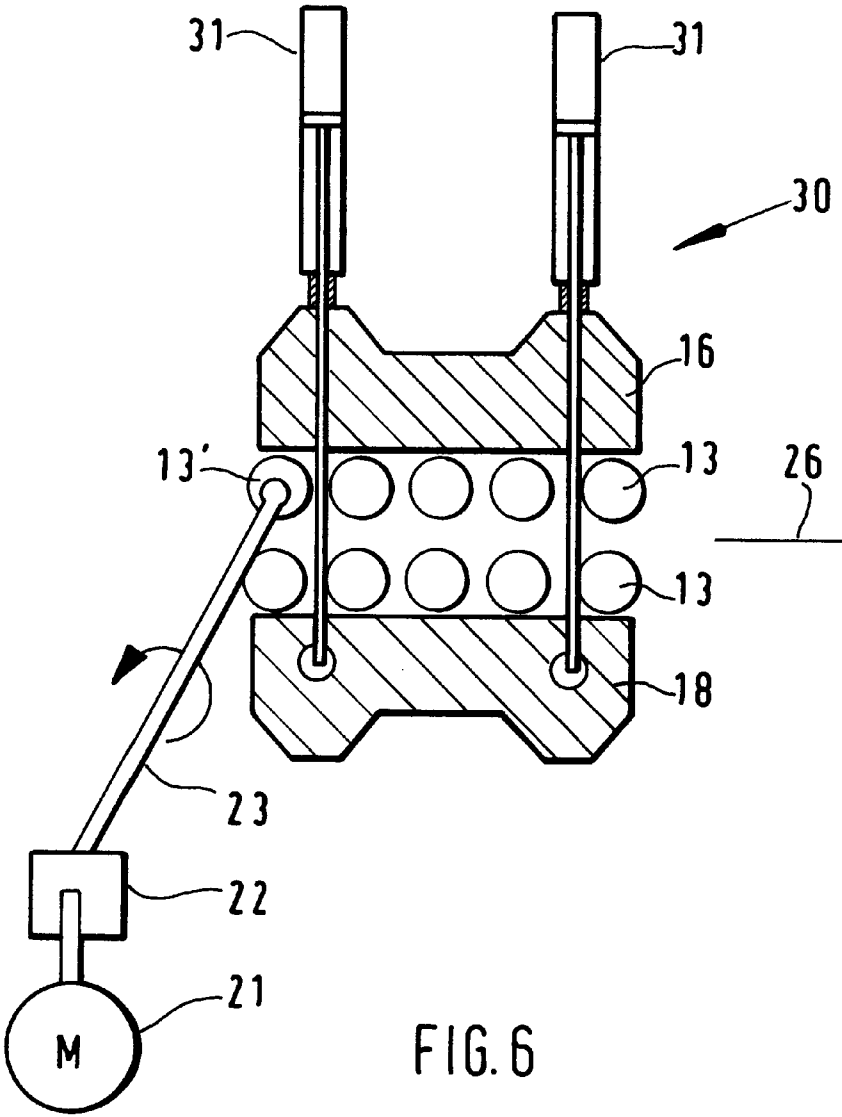
FIG. 6 is a sectional view of a segment according to the present invention, shown with drive.

FIG. 6 shows a segment 30 according to the present invention in a sectional view extending parallel to the conveying direction 26. The segment 30 includes a drive roller 13" which is arranged at the segment edge; in the illustrated embodiment, the drive roller 13 ' is arranged at the entry side of the segment in relation to the conveying direction 26; this is possible because by means of the position-controlled and force-controlled segment adjusting cylinders 31 the required adjusting force for the drive roller 13' has been moved towards the segment edge, so that separate adjusting cylinders for the drive roller 13', as they are used in the conventional segment 14, are no longer required.

Figure 7:
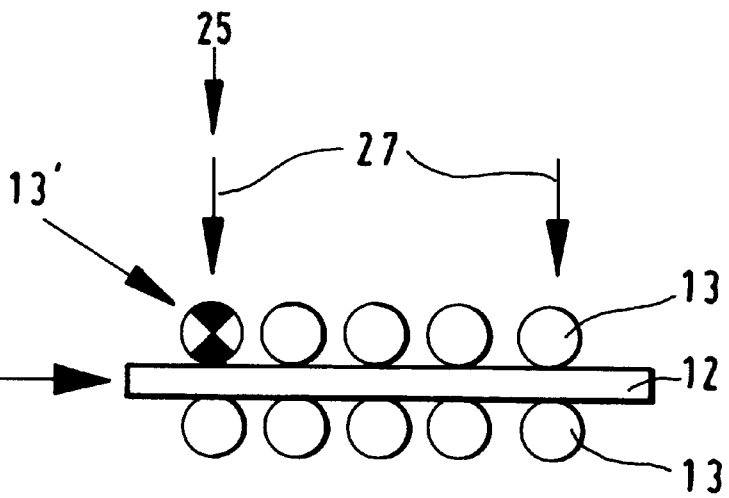
FIG. 7 is a schematic illustration of the forces to be applied on a segment according to FIG. 6.

Similar to FIG. 3, FIG. 7 illustrates the forces to be applied by the hydraulic cylinders. In this case the hydraulic cylinders are the hydraulic adjusting cylinders 31. The adjusting forces are the same adjusting forces 25 for transmitting the strand conveying forces; however, the forces are no longer applied by two separate adjusting cylinders 20 as shown in FIG. 2, but by two segment adjusting cylinders 31. Additional adjusting forces must be applied by the segment adjusting cylinders 31 in order to compensate for the ferrostatic load of the strand;

the soft reduction; and the force of the weight.

In the segment according to the present invention, these forces are smaller than in the conventional segment 14 because clamping forces are no longer to be applied and only the forces required by the cast strand or its conveyance are to be introduced.

The measures and features of the present invention shown in the illustrated embodiment can be used in the same manner in segments having two drive rollers, wherein, in the accordance with the present invention, the drive rollers may also be arranged at the exit side of the segment.

While specific embodiments of the invention have been shown and described in detail to illustrate the inventive principles, it will be understood that the invention may be embodied otherwise without departing from such principles.

We claim:

1. A method for producing slabs in a continuous casting plant including a strand guiding means arranged following a casting mold and divided into segments, each segment being composed of a two-part segment frame, rollers, and hydraulic cylinders for bracing the frame parts relative to each other, wherein the rollers are arranged in pairs opposite each other and being mounted in the frame parts for supporting and conveying the solidifying cast strand, wherein at least one of the rollers is a drive roller located at a segment edge of the segment and being pressed with a defined adjusting force against the cast strand for transmitting strand conveying forces, the method comprising: supporting the cast strand by bracing the segment frame parts in an infinitely variable manner by means of position-controlled and force-controlled segment adjusting cylinders; and conveying the cast strand, wherein the segment adjusting cylinders also apply an adjusting force required for the drive roller for transmitting the strand conveying forces to the cast strand.

2. The method according to claim 1, wherein each segment has four segment adjusting cylinders, comprising controlling the segment adjusting cylinders with respect to position and force such that the required adjusting force for transmitting the conveying forces is transmitted to at least one drive roller at a segment edge of the segment.

3. The method according to claim 1, wherein the segment adjusting cylinders have an infinitely variable position control and force control and wherein the adjusting force applied by the segment adjusting cylinders is varied as needed by the infinitely variable position control and force control of the segment adjusting cylinders to prevent blocking of the strand by the drive roller.

4. The method according to claim 1, wherein the segment adjusting cylinders have an infinitely variable position control and a force control and wherein the adjusting force applied by the segment adjusting cylinders is varied as needed by the infinitely variable position control and force control of the segment adjusting cylinders to prevent slip of the drive roller.

5. A continuous casting mold for producing slabs comprising strand guide means arranged following a casting mold and divided into segments, each segment comprising a two-part segment frame, rollers, and hydraulic cylinders for bracing the frame parts relative to each other, wherein the rollers are arranged in pairs opposite each other and being mounted in the frame parts for supporting and conveying the solidifying cast strand, wherein at least one of the rollers is a drive roller located at a segment edge of the segment and being pressed with a defined adjusting force against the cast strand for transmitting strand conveying forces, wherein each segment comprises four position-controlled and force-controlled segment adjusting cylinders for connecting and bracing the two segment frame parts at a distance from each other, wherein the four segment adjusting cylinders provide the adjusting force acting on the drive roller.

6. The continuous casting plant according to claim 5, wherein one of the rollers is a drive roller, and wherein the drive roller is arranged at a segment edge.

* * * * *